United States Patent [19]

Gougeon et al.

[11] Patent Number: 4,469,040

[45] Date of Patent: Sep. 4, 1984

[54] SAILBOAT WING SPAR STRUCTURE

[76] Inventors: Jan C. Gougeon, 249 Lagoon Beach, Bay City, Mich. 48706; Georg K. Thomas, 1785 N. Golfview, Essexville, Mich. 48732

[21] Appl. No.: 368,226

[22] Filed: Apr. 14, 1982

[51] Int. Cl.³ ..... B63H 9/04

[52] U.S. Cl. ..... 114/104; 114/39

[58] Field of Search ..... 114/102, 103, 104–108, 114/89–91

[56] References Cited

U.S. PATENT DOCUMENTS 3,132,620 5/1964 Court ..... 114/102

3,485,197 12/1969 Brett ..... 114/102

4,367,688 1/1983 Godfrey ..... 114/107

*Primary Examiner*—Trygve M. Blix

*Assistant Examiner*—Jesûs D. Sotelo

*Attorney, Agent, or Firm*—Learman & McCulloch

[57] ABSTRACT

A sailboat hull and deck structure has a tubular bearing assembly fixedly supported by the hull and deck structure and a hollow mast is journaled by said bearing assembly and extends vertically upwardly therefrom. A sail for the mast has at least one sail control line leading down through the mast and there is an opening in the bearing assembly in the lateral wall thereof to pass the sail control line.

2 Claims, 4 Drawing Figures

SAILBOAT WING SPAR STRUCTURE

This invention relates to sailboat constructions and particularly to so-called wing spar sailing vessels, wherein a rotatable mast is provided.

BACKGROUND OF THE INVENTION

The invention is particularly concerned with the mount structure for the mast or spar, and the manner in which sail control lines permit one man to sail vessels of considerable size. In the so-called conventional sailboat, when the boat is either reaching or beating to windward, the mast causes considerable turbulence along the leeward side of the sail because it prevents a smooth entry of the wind to the leeward surface of the sail. This is because the shape of the mast disturbs the air flow on the back or leeward side of the sail and this laminar flow of air on the leeward side of the mast sail has a considerable effect on the efficiency of the sail, particularly in rough weather sailing.

The problem is solved with the use of a properly shaped, rotatable wing spar which permits the spar to rotate to a position in which it is "aerodynamically clean" in the sense that the air flow transition from mast to sail is smooth, and an excellent and controllable leading edge entry can be obtained.

The problem solved by the wing spar is described in U.S. Pat. No. 4,230,060 and U.S. patent literature which should be considered when putting the invention into proper perspective relative to the prior art includes U.S. Pat. Nos.:

2,561,253; 3,874,313; 4,090,461; 4,230,060.

Basically, we recognize that rotating masts have been used with considerable success, but to our knowledge they have not been so mounted and controlled that one man, from a position away from the mast (such as the cockpit) can effectively control the hoisting, reefing, shaping and lowering of the sail.

SUMMARY OF THE INVENTION

The present invention is concerned with a sailboat having a rotatable, hollow mast which is rotatably supported by a bearing assembly fixed in the hull and deck structure. At least one sail control line extends downwardly within the mast in an axial direction, and out an opening provided in the bearing below the mast. It can, from there, extend across the deck, to a cockpit or into the cabin.

One important object of the invention, therefore, is to provide a rotatable wing spar which is so designed, and whose sail is so controlled, that one person from a location of some distance from the mast, can perform such functions as raising and lowering the sail, and reefing the sail.

Another object of the invention is to provide a structure adaptable, for instance, to the replacement of round aluminum spars functioning as the main and mizzen masts of a ketch with lightweight, rotating, shroudless wing spars which are rigidly supported for rotation in a manner to dramatically improve the boat's performance, particularly when sailing upwind.

Another object of the invention is to provide a spar support structure which accommodates sail control lines and makes provision in this bearing support structure for passage of such sail control lines as desired over to a location remote from the wing spar, from which one person can single-handedly sail the boat.

Other objects and advantages of the invention will be pointed out specifically, or will become apparent from the following description when it is considered in conjunction with the appended claims and the accompanying drawings.

DESCRIPTION OF THE PREFERRED EMBODIMENT

Figure 1:
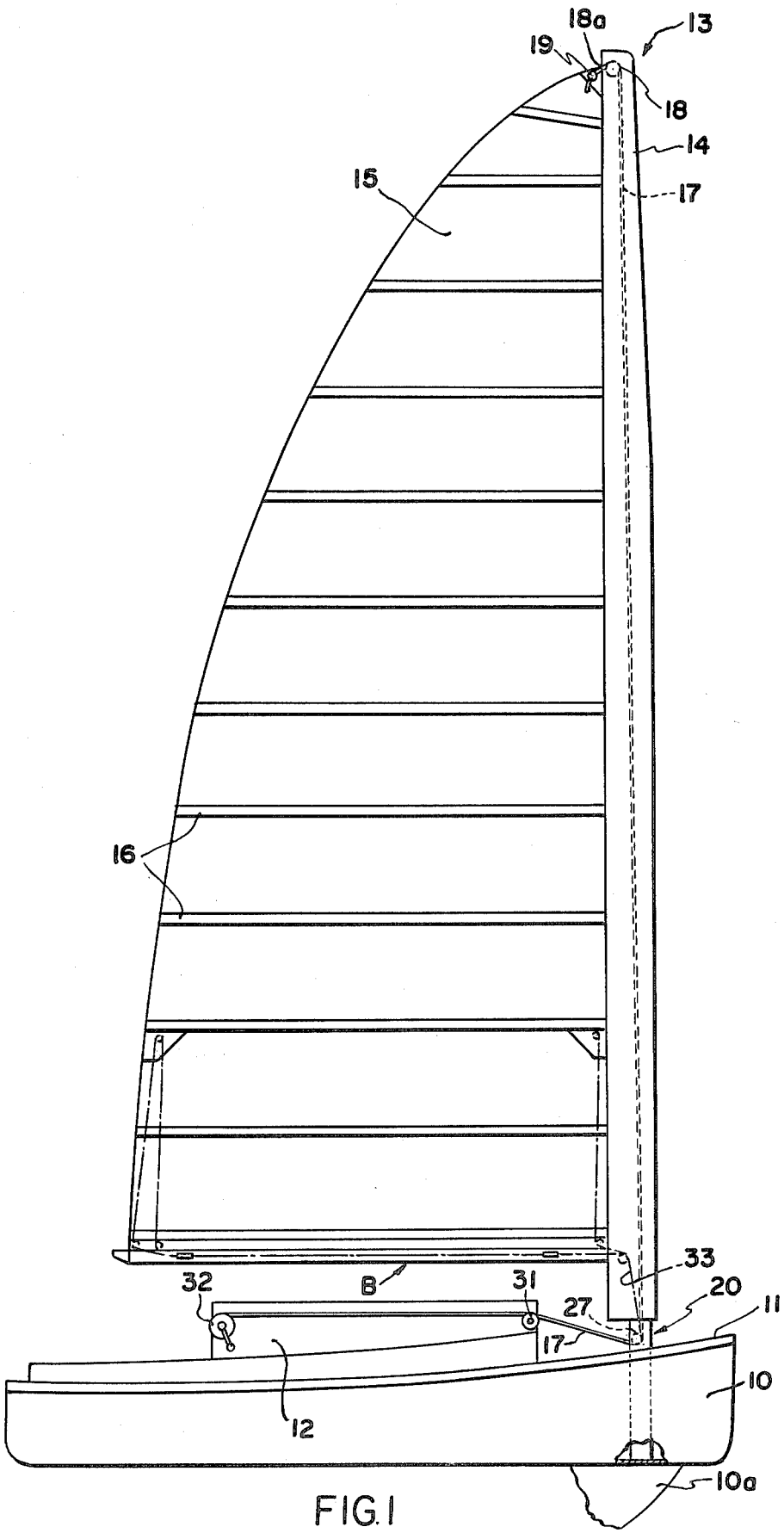
FIG. 1 is a side elevational view of a typical sailboat which employs the invention.
Figure 2:
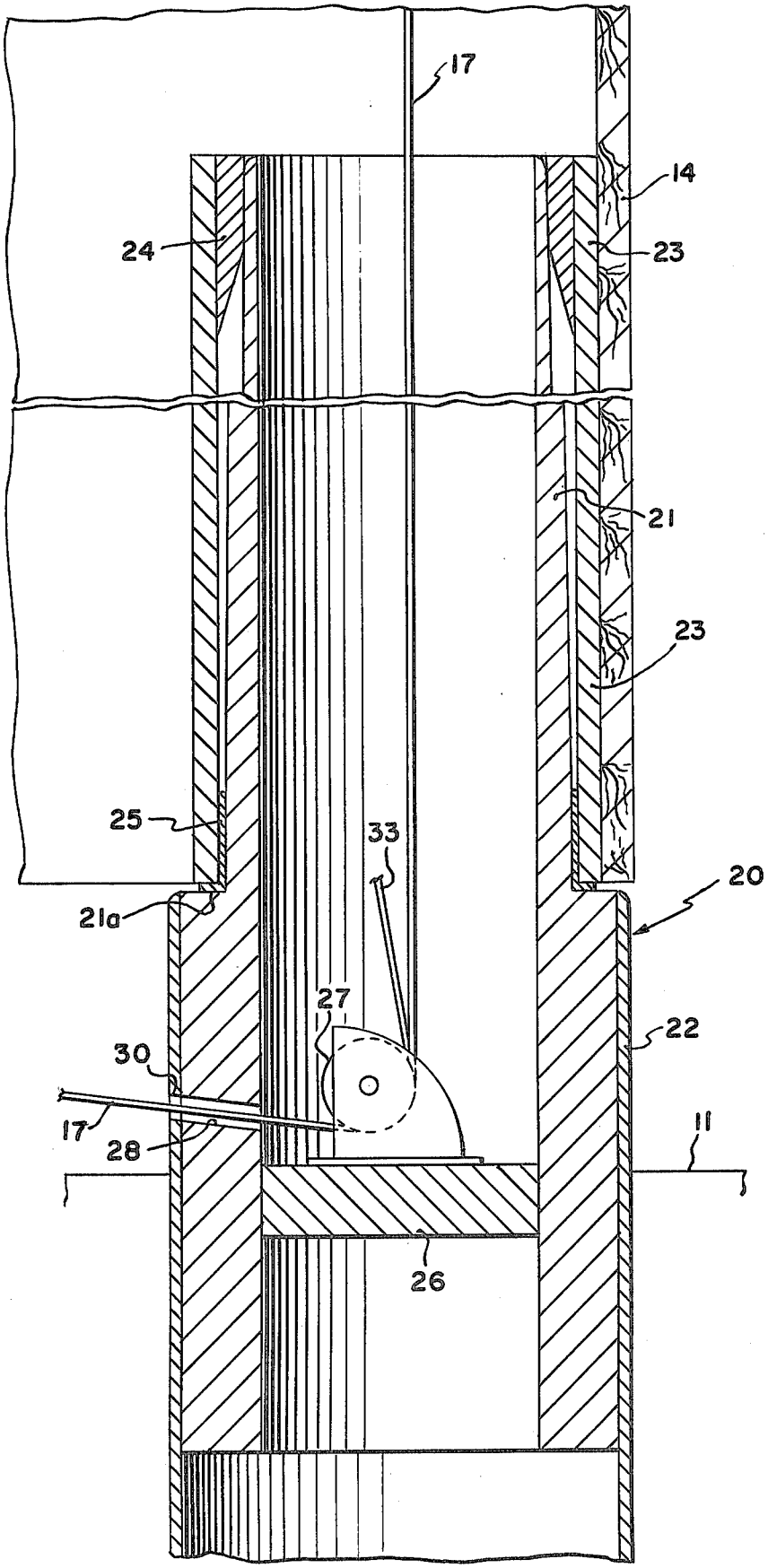
FIG. 2 is a greatly enlarged, sectional side elevational view through the mast mount structure.
Figure 3:
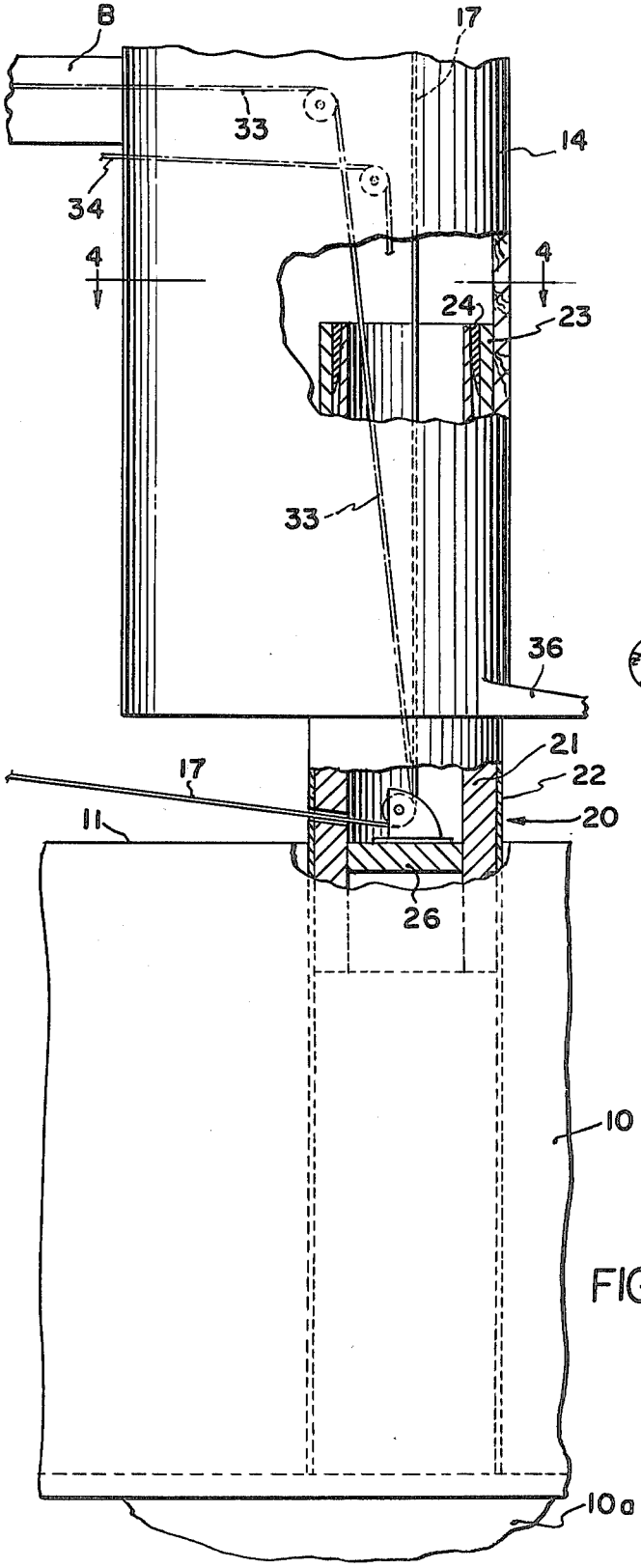
FIG. 3 is an enlarged fragmentary elevational view of elements of the bearing structure shown in FIG. 1, with portions broken away in the interests of clarity.
Figure 4:
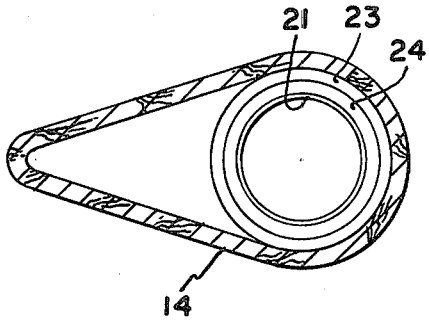
FIG. 4 is a transverse sectional view taken on the line 4—4 of FIG. 3.

The sailboat shown in FIGS. 1 and 2, as usual, includes a hull 10 which may, for purposes of illustration, be considered to be in the neighborhood of twenty-five feet in length. It should be appreciated, however, that the invention is adaptable to boats of greater and lesser length, and various types, both monohull and multihull in configuration. Provided as part of the hull (which is illustrated as having a keel 10*a*) is a deck generally designated 11, and, mounted on the hull as an integral portion thereof, is a cabin wheelhouse 12, or cockpit providing an area or location within which the conventional steering mechanism may be located.

The sailing system for the boat, generally designated 13, includes a hollow mast or spar 14, a mainsail 15 fully battened with battens 16, boom B, and a halyard 17. The mast 14 at its upper end, interiorly mounts a pulley or sheave 18 around which the halyard 17 is trained. This end of the halyard 17 passes laterally out an opening 18*a* provided in the mast 14, to attach to an eye member 19 or the like in sail 15. The mast 14 in the usual fashion includes a sail track or the like which facilitates the raising and lowering of sail 15.

Provided in the deck structure, in fixed position relative thereto, is an internal bearing structure generally designated 20 (see FIG. 2), comprised of an upwardly extending support tube 21, which is shouldered as at 21*a*. Sleeve 21 may be adhesively rigidly fixed to the hull and deck structures via tube 22. The sleeve 21, above a shoulder 21*a*, may taper gradually to a reduced size upper end. A sleeve or roller bearing 24, functioning as a top bearing, is provided between the tube 21 and a guide tube structure 23 adhesively or otherwise rigidly fixed in the lower end of mast 14 and mast 14 seats upon the step provided by a lower thrust bearing 25, which is supported upon shoulder 21*a*. The bearing structure is rigidly, non-rotatably supported by the deck and hull and keel structure, and mast 14 is freely externally rotatable relative to bearings 24 and 25.

Provided within the tube 21 is a platform 26, mounting a sheave or pulley 27 (which may be a double or triple pulley) within bearing tube structure 21 below the level of mast 14, and it will be seen that halyard 17 is trained around pulley 27 and can proceed out openings 28 and 30 provided in the bearing structure. As indicated in FIG. 1, the halyard 17 then may pass around a pulley structure 31 and over to a motor or hand-operated winch 32 provided on the aft end of cabin 12.

The halyard 17 is a sail control line, and it is to be understood that the hollow mast 14 may also accommodate other sail control lines, such as the reefing line 33, or the boom vang control line 34. All of these lines may also aptly be termed sail control lines, and may be brought down through mast 14 and bearing structure 20 and out openings in the bearing structure similar to openings 28 and 30, or out openings 28 and 30 and over around pulleys to winches such as shown at 31 or the like at location 32.

Provided on the lower end of the mast or wing spar is an arm member 36 which can be cleated to the deck to prevent undue rotation of the mast 14.

The sail controlling lines which are brought down through openings in the mast and pass out through openings in the fixed bearing structure are unaffected by mast rotation. In operation, the operator can merely manipulate the sail control line 17, or other sail control lines, with winches disposed at location 32, because the rotation of mast 14 does not affect them in any disadvantageous manner.

It is to be understood that the drawings and descriptive matter are in all cases to be interpreted as merely illustrative of the principles of the invention, rather than a limiting the same in any way, since it is contemplated that various changes may be made in various elements to achieve like results without departing from the spirit of the invention or the scope of the appended claims.

We claim:

1. A sailboat including a hull and a deck mounted at a level above the bottom of the hull; a vertically axially extending, rotatable, wing spar hollow mast of generally teardrop shape in cross section, with one end provided with a semi-cylindrical portion; a wheelhouse cockpit for said sailboat remote from said mast; a tubular bearing mount structure fixedly supported by the hull and extending above the deck the bearing mount structure including a stepped portion forming a shoulder at a spaced distance above the deck from which a reduced diameter cylindrical portion extends upwardly to receive the lower end of the rotatable mast; bearing means between the semi-cylindrical portion of the mast and the reduced diameter cylindrical portion permitting the latter to support the mast for rotation on the reduced diameter portion, the bearing means including thrust bearing means for supporting said mast axially above said shoulder; a sail for the mast mountable to be drawn upwardly from a furled position to an operative position; a halyard connected to the upper end of the sail extending into the interior of the mast and downwardly therein and out the lower end thereof; there being an opening in the said reduced diameter portion between the shoulder and deck; line guiding means mounted within said reduced diameter portion below the mast around which the halyard is trained to guide it for vertical travel in said mast and out said opening; and winch means at said cockpit to which said halyard connects so that it can be operated to raise the sail by the same person who is steering the sailboat.

2. The improved sailboat of claim 1 wherein the bearing comprises a tubular frame fixed to said hull and deck structure; the frame having a shoulder portion with a thrust bearing thereon for receiving the butt end of the mast, and there being a sleeve bearing provided in the frame near the upper end thereof for journaling the mast above its lower end.

* * * * *